US006745756B1

(12) United States Patent
Achkar

(10) Patent No.: US 6,745,756 B1
(45) Date of Patent: Jun. 8, 2004

(54) BOW CARRYING AND SUPPORT STRUCTURE

(76) Inventor: Nibal Achkar, Box 1420, Biggar, Saskachewan (CA), S0K 0M0

( * ) Notice: Subject to any disclaimer, the term of this patent is extended or adjusted under 35 U.S.C. 154(b) by 0 days.

(21) Appl. No.: 10/327,613

(22) Filed: Dec. 24, 2002

(51) Int. Cl.[7] ..... F41B 5/14
(52) U.S. Cl. ..... 124/88; 124/23.1
(58) Field of Search ..... 124/23.1, 24.1, 124/86, 88, 89; 16/110.1, 421, 430

(56) References Cited

U.S. PATENT DOCUMENTS

| | | | | |
|---|---|---|---|---|
| 2,344,799 A | * | 3/1944 | Brown et al. | 124/22 |
| 3,490,662 A | * | 1/1970 | Ramsey | 124/88 |
| 3,623,468 A | * | 11/1971 | Crest | 124/24.1 |
| 3,834,368 A | | 9/1974 | Geiger | |
| 4,457,287 A | | 7/1984 | Babington | |
| 4,674,472 A | * | 6/1987 | Reis | 124/89 |
| 5,240,211 A | * | 8/1993 | Anderson | 248/125.3 |
| 5,333,595 A | * | 8/1994 | Heffron | 124/88 |
| 5,522,376 A | | 6/1996 | Collinsworth | |
| 5,718,213 A | | 2/1998 | Gallops, Jr. et al. | |
| 6,012,439 A | * | 1/2000 | Woodruff | 124/1 |
| 6,070,569 A | * | 6/2000 | Chalin et al. | 124/86 |

OTHER PUBLICATIONS

Golden Key Arrow Trap p. 12 "Arrowtrade" Jan. 2003.
Golden Key Futura Inc. Brochure p. 1 Arrow Trap.
Arrow Trap ATA ( Archery Trade Association) Tradeshow Guide Jan. 17–19, 2003 p. 69.

* cited by examiner

*Primary Examiner*—Kien Nguyen
(74) *Attorney, Agent, or Firm*—Ridout & Maybee LLP

(57) ABSTRACT

A rigid structure for carrying and supporting an archery bow is disclosed herein. The structure comprises a gripping portion adjoined to an attachment portion or portions so as to form an open L-shape or closed U-shape and a means for connecting the attachment portion or portions to the riser on an archery bow. The structure is adapted to be secured by connecting means to a central region of the riser of an archery bow, such that when normally carried, the archery bow, on either side of the riser, is carried away from and downwardly from the riser. This positioning of the structure lowers the center of gravity below the store to permit the archery bow to maintain balance from side to side and end to end when being carried by an archer.

16 Claims, 4 Drawing Sheets

BOW CARRYING AND SUPPORT STRUCTURE

FIELD OF THE INVENTION

The present invention relates to a structure for carrying and supporting an archery bow, as well as adding additional structural integrity to the riser.

BACKGROUND OF THE INVENTION

Handle devices to simplify carrying and holding an archery bow are already known in the art. However, many of these devices are unsatisfactory, in that they do not allow for the archery bow to be easily or efficiently carried by the archer since the handle is often positioned on the inside of the riser. This positioning of the handle causes the bow to be unbalanced when carried and can result in discomfort for the archer and shoulder fatigue, particularly when the bow must be carried for extended periods of time.

Another problem with handles that are positioned in this manner is that the string and power cables have a tendency to come into contact with the archer's clothing and hands. As well as direct mount arrow quivers and/or high cable guards. This can be an additional source of discomfort to the archer and, over time, will often result in war of the bow finish. Additionally, as the sight and stabilizer are positioned toward the ground when the handle is attached to the inside of the riser, these components of the bow are prone to damage when obstructions are encountered while the bow is being carried by an archer. An example of such a device is disclosed in U.S. Pat. No. 6,522,376 to Collingsworth, which teaches a handle for an archery bow, which is positioned on the inside of the bow riser.

Other devices have attempted to overcome these difficulties by positioning the handle on the other side of the riser. Examples of such a device are taught in U.S. Pat. No 4,457,287 to Babington, which discloses a universally mounted handle which acts as a handgrip for the archer when shooting an arrow and U.S. Pat. No. 3,834,368 to Geiger, which teaches a combination archery bow and sling shot having a hand grip. Although the handle devices taught in Babington and Geiger are somewhat more successful in preventing the strings of the bow from coming into contact with the hands and doing of the archer, these devices and other similar devices are still rather unsatisfactory, in that they do not permit the bow to remain in a balanced position while being carried by an archer. This is largely due to the fact that such handle devices are typically situated below other components of the bow. As a result, the side to side and end to end balance of the bow is unstable and easily disturbed when the bow is being carried.

A further difficulty with devices such as the ones disclosed in Babington, Collingsworth and Geiger lies in their inability to be used in conjunction with bows that have a low brace height and/or direct mount arrow quivers and/or high cable guard systems. This construction prevents the devices from being easily supported by mounting or hanging devices.

SUMMARY OF THE INVENTION

Accordingly, it is an object of the present invention to provide an improved structure for carrying and supporting an archery bow which will allow a bow to be transported in such a manner that the string and power cables will have minimal contact with the archers clothing and hands. It is a further objective of the present invention to provide a carrying and support structure for a bow which will reduce the amount of wear on the bow finish and protect other components attached to the bow, such as sights and stabilizers, from damage when obstructions are encountered. It is another object of the present invention to provide a structure for carrying and supporting an archer bow which is balanced so as to reduce discomfort to the archer when carrying the bow and help to prevent shoulder fatigue from occurring when the archer must carry the bow for extended periods of time. It is a further objective of the present invention to provide a structure for supporting and carrying an archery bow which can permit an archer to hang his or her bow on a tree branch, or other hanging device and secure the bow to a mounting deice on the ground or on a bench.

As an archery bow has a built in inherent weakness of the riser by design which is located at the grip (throat) it is a further objective of one embodiment of the present invention to alleviate this weakness by incorporating the invention into the riser during manufacturing. This embodiment will substantially contribute additional strength in this area.

These and other objectives are accomplished by providing a structure for carrying and supporting an archery bow, wherein the structure is equipped with a gripping portion which is adjoined to an attachment. A connecting means is provided to be connected to the riser of the archery bow. The form of the structure permits easy and efficient hanging of the bow and allows the bow to be supported within an ancillary mounting device. Additionally, when the structure is secured to the central region of the riser of an archery bow, such that when carried, the archery bow, on either side of the riser, is curved away from and downwardly from the riser and all other bow components rest below the structure, the center of gravity is lowered and the balance from side to side and end to end of the bow can be maintained in order to reduce any discomfort or arm and shoulder fatigue on the part of the archer.

In order to permit other instruments such as a broadhead wrench, a sling or an arrow rest to be attached to the structure and transported or kept with the bow, the structure is provided optionally with one or more apertures. The structure is also adapted to be adjustably attached to the riser of the archer bow by means of an elongated slot which can be angled according to the preference of the archer.

BRIEF DESCRIPTION OF THE DRAWINGS

These and other advantages of the invention will become apparent upon reading the following detailed description and upon referring to the drawings in which.

Figure 1:
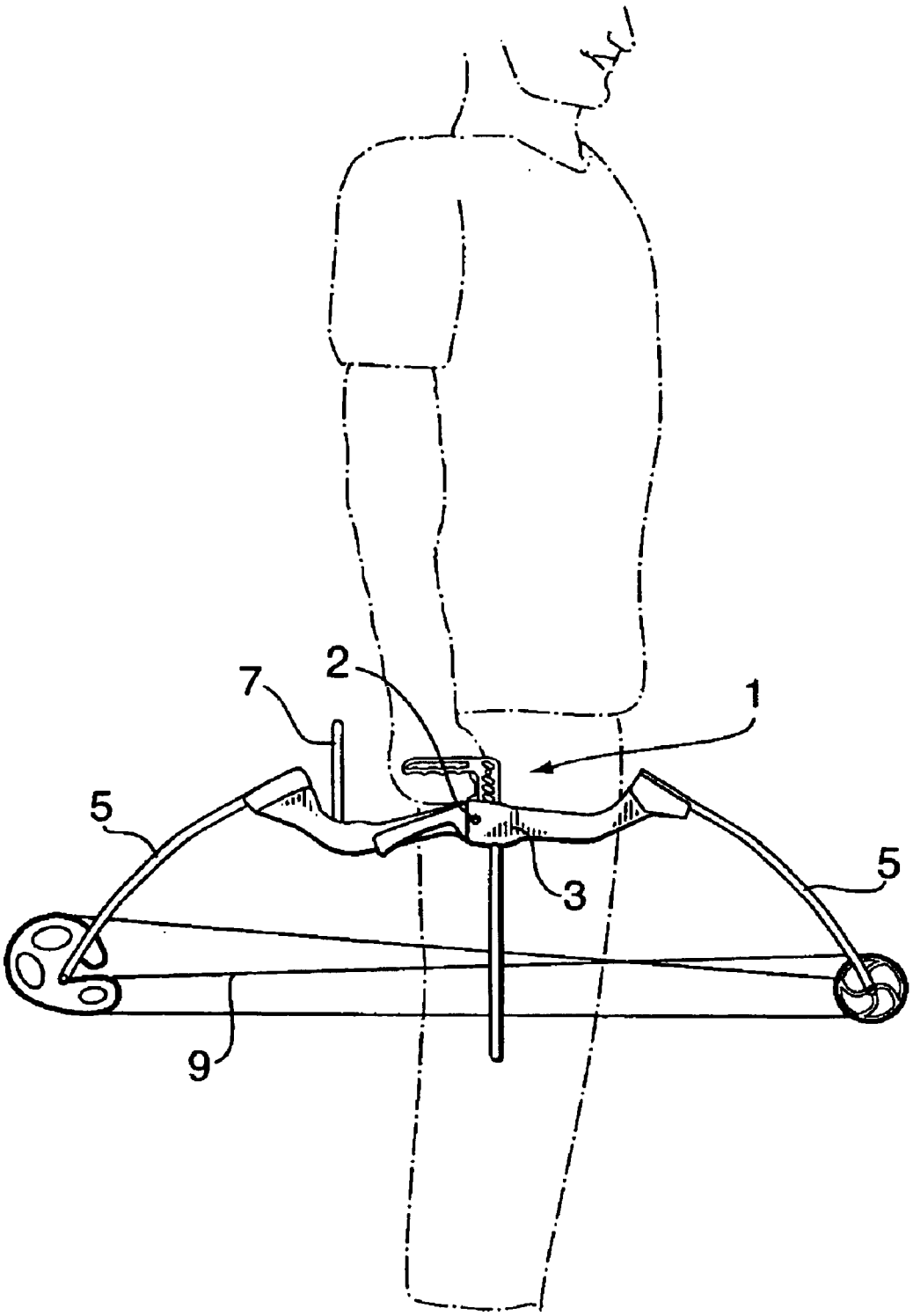
FIG. 1 is a side view of the carrying and support structure according to the present invention mounted to an archery bow.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE DRAWINGS

In the following description, similar features in the drawings have been given similar reference numerals.

Turning to FIG. 1, there is illustrated a carrying and support structure (1) according to the present invention. This structure (1) is connected by connecting means to a standard mounting hole (2) in the riser (3) of an archery bow (5). The structure (1) is attached to the central region of the riser (3) on an archery bow (5). In forward orientation and away from the riser (3).

This positioning of the structure (1) on the bow (5) permits the bow (5) to remain balanced from side to side and end to end when carried by the archer. The balance is able to be maintained in this way, because the structure (1) is attached to the central region of the bow riser (3) and extends above other components of the bow (5). Additionally, as can be seen in FIG. 1, the ends of the bow (5) on either side of the riser (3) are curved away from and downwardly from the riser (3) so that the center of gravity of the bow (5) will be below the structure (1).

This balance achieved by structure (1) when it is thus positioned on bow (5) is advantageous as it serves to reduce the amount of contact between the string and power cables (9) and the archer's hands or clothing, which contact can otherwise cause some discomfort for the archer and result in wear on the bow finish over time. This particular positioning of the structure (1) on the riser (3) of the bow (5) is also advantageous in that it ensure that other bow components, such as sights and stabilizers (7) are not in close proximity to the ground when the bow is being carried. As a result, such components are protected from damage when any obstructions are encountered while the archer is transporting the bow (5).

Figure 2:
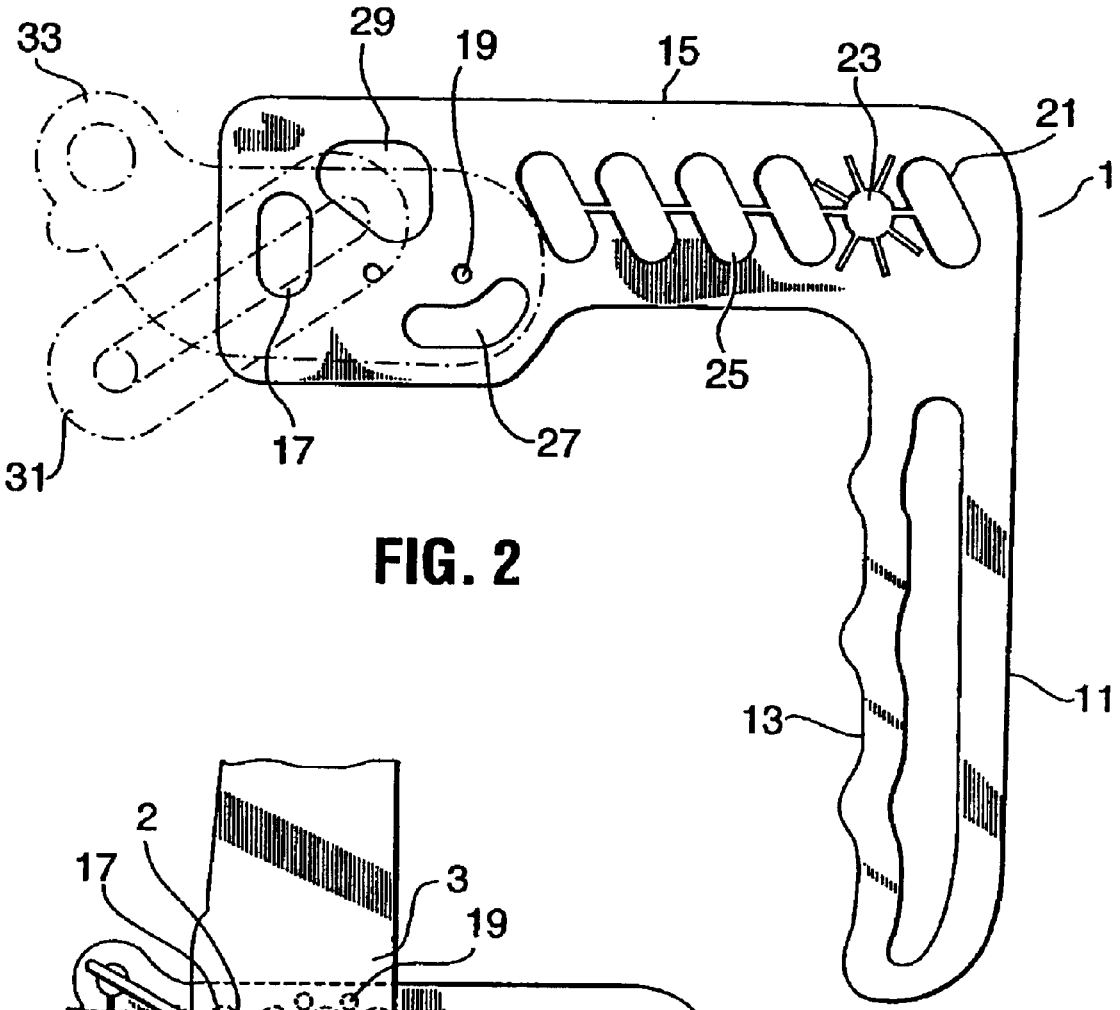
FIG. 2 is an enlarged side view of the carrying and support structure adapted to allow other instruments to be attached thereto.
Figure 3:
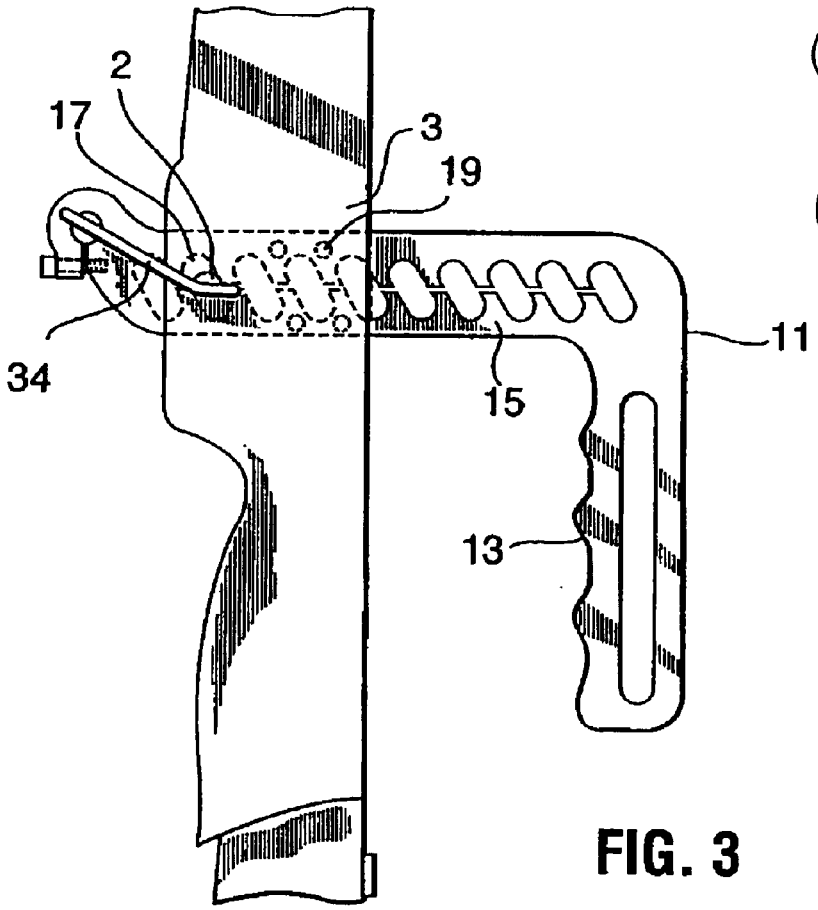
FIG. 3 is a side view of the carrying and support structure of FIGS. 1 and 2, in combination with a particular type of arrow rest.

The structure (1) is shown in greater detail in FIGS. 2 and 3. As shown in FIG. 2, the structure (1) is essentially composed of a gripping portion (11) which is equipped with a plurality of grooves (13) to permit the archer to grasp and hold on to the structure (1) in order to hold or transport the bow (5). The gripping portion (11) is integrally attached to an attachment portion (15) which, as shown in FIG. 3, permits the structure (1) to be attached to the riser (3) of an archery bow (5) by connecting means which consist generally of an elongated slot (17) on the attachment portion (15) which permits the structure (1) to be adjustably secured with screws or bolts or other conventional connecting means (not illustrated) to the standard mounting hole (2) on the riser (3) of a bow (5). Additional screws (19) may also optionally be used to assist in securing the attachment portion (15) of the structure (1) to the riser (3) on the bow (5), although they are not necessary. The attachment portion (15) forms an L-shape with the gripping portion (11). This "open" design permits the bow (5) to be easily grasped by the archer and easily secured to or supported by hanging or ancillary mounting device. Such devices are illustrated in FIGS. 4 and 5 and will be discussed in greater detail below.

As shown in FIGS. 2 and 3, the attachment portion (15) can be equipped with a variety of apertures to permit other instruments to be attached to the structure (1). For example, an elongated corner slot (21) can be provided at the corner where the attachment portion (15) is adjoined to the gripping portion (11) so that a sling clip can be attached to the structure (1). Additionally, a broadhead wrench (23) can be incorporated into the device (11) which can also serve as a means to attach other devices (e.g. a vibration damper). Various apertures (25, 27 and 29) of other sizes, angles and shapes can also be provided in the attachment portion (15) to permit other instruments to be attached and/or reduce the overall weight of the structure (1). As shown in FIG. 2, the attachment portion (15) can also be adapted with different attachments (phantom 31 and 33) to permit different types of arrow rests to be attached to the attachment portion (15). In FIG. 3 a particular type of arrow rest (34) in combination with the structure (1), is shown.

Figure 4:
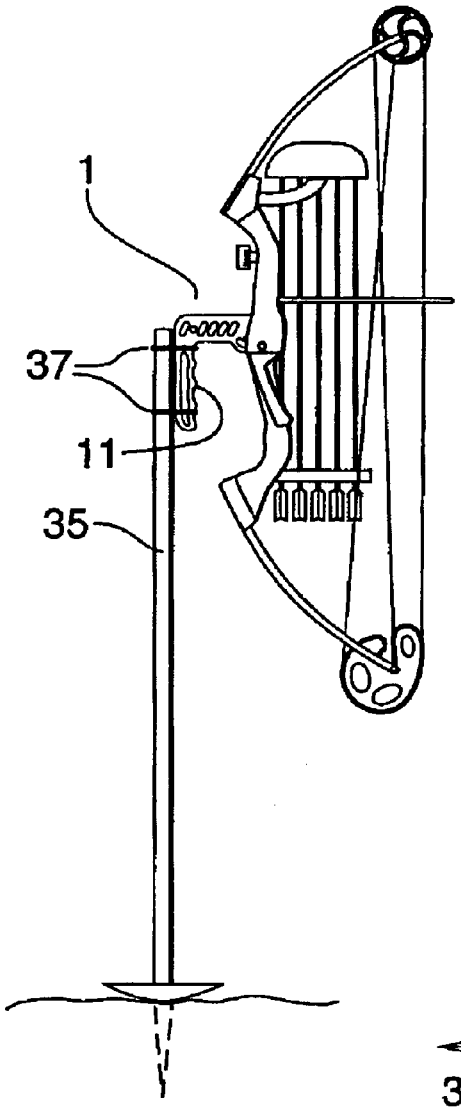
FIG. 4 is a schematic side view of the carrying and support structure of FIGS. 1 and 2, attached to an archery bow and supported by a ground mounting device.
Figure 5:
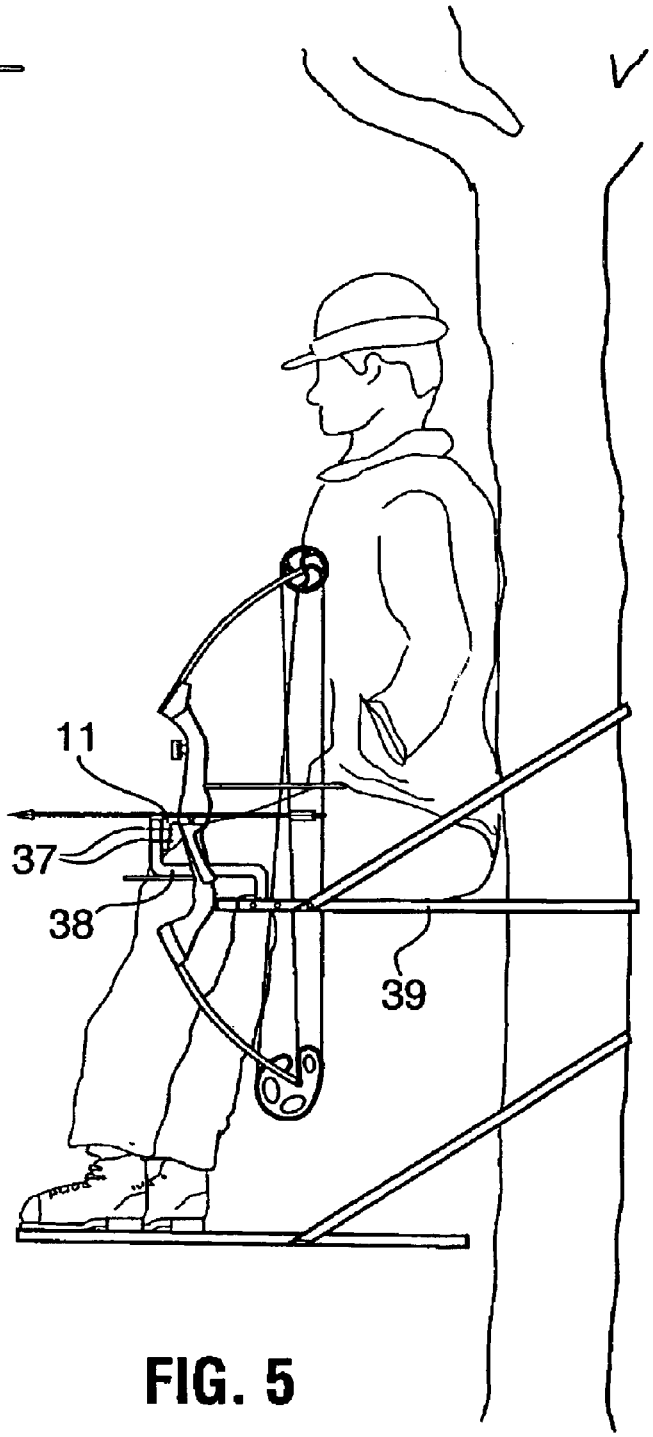
FIG. 5 is a schematic side view of the carrying and support structure of FIGS. 1 and 2 attached to an archery bow and supported by a seated mounting device.

FIG. 4 shows the structure (1) secured to a mounting device (35) which can be firmly implanted in the ground. The gripping portion (11) of the structure (1) is shown secured to the mounting device (35) by means of releasably by securing brackets (37). FIG. 5 illustrates how the structure (1) may also be releasably secured to a similar curved mounting device (38) for a flat surface such as a bench or tree stand (39).

Figure 6:
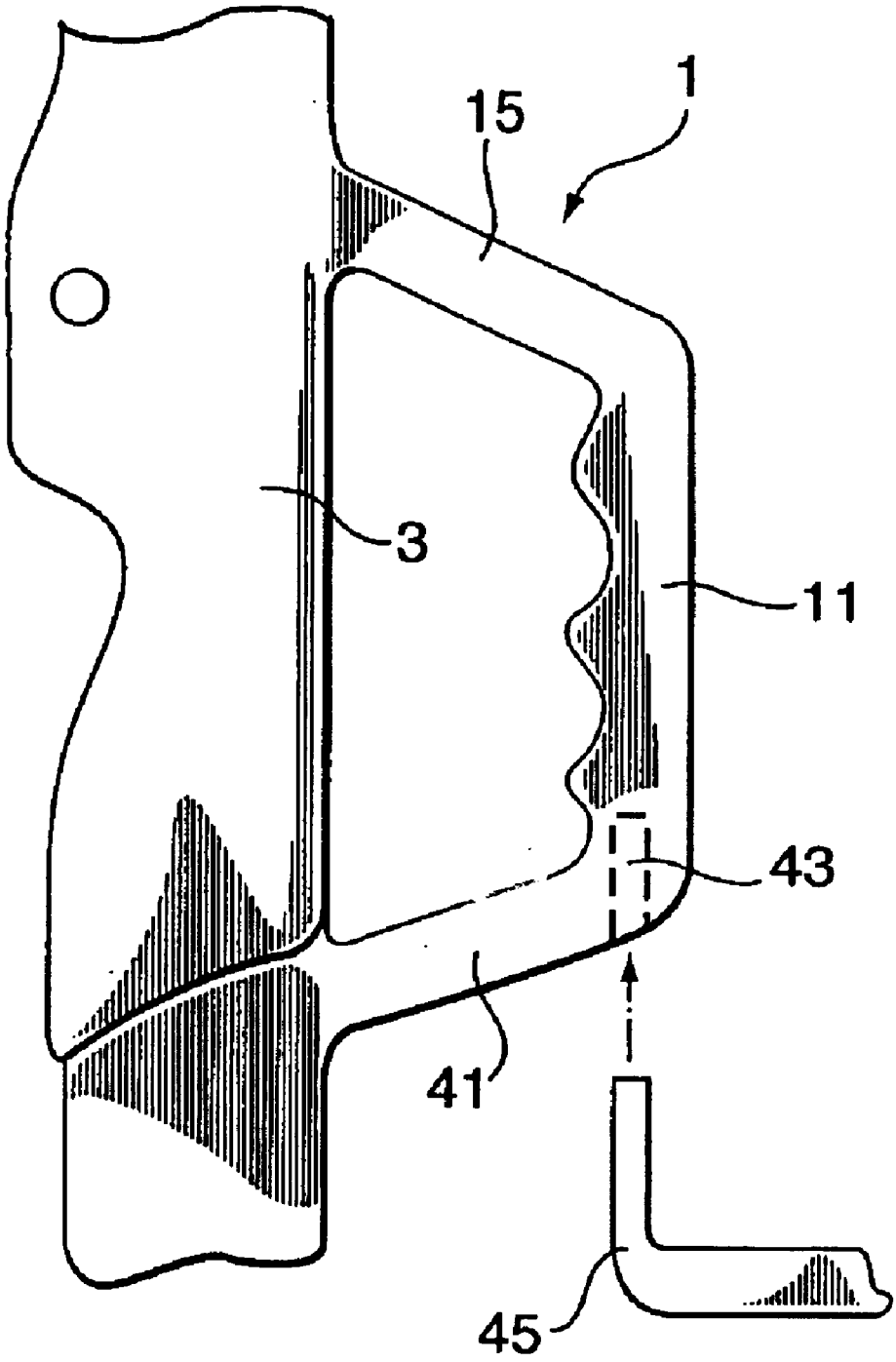
FIG. 6 is a schematic partial side view of an alternative embodiment of carrying and support structure secured to the riser of an archery bow.

FIG. 6 illustrates an alternative embodiment of structure (1) in accordance with the present invention. In this case, gripping portion (11) has, instead of just a single attachment portion (15) at one end, a corresponding attachment portion (41) at the other end, permitting structure (1) to be secured to the riser by various means. For instance, it may be built in at manufacture as one unit with the riser or it may be attached by other means, e.g. welding, bolt, screw. This embodiment of structure has a generally U-shaped "closed" design, when viewed from the side, as illustrated. An aperture (43) may be formed in one end of gripping portion (11) as illustrated, to releasably receive an end (45) of mounting device (35) or (38). While not illustrated, an elongated corner slot (21) as illustrated in FIG. 2 can be provided at the corner where the attachment portion (15) is adjoined to the gripping portion (11) so that a sling clip can be attached to the structure (1). The device, as illustrated in FIG. 6 will substantially contribute additional strength to the riser at its weakest point. A broadhead wrench (23) may be incorporated similar to FIG. (2) as well as various apertures (25, 27, 29) (FIG. 2).

Thus, it is apparent that there has been provided in accordance with the present invention a carrying and support structure for an archery bow that fully satisfies the objects, aims and advantages set forth above. While the invention has been described in conjunction with illustrated embodiments thereof, it is evident that many alternatives, modifications and variation will be apparent to those skilled in the art in light of the forgoing description. Accordingly, it is intended to embrace all such alternatives, modifications and variations as fall within the spirit and broad scope of the invention.

What is claimed is:

1. A rigid structure for attachment at a single location to an archery bow in forward orientation for carrying and supporting the bow, the structure comprising:

a gripping portion;

a first attachment portion adjoined to the gripping portion, the gripping portion and first attachment portion forming an L-shape; and a means for connecting the first attachment portion to a riser on an archery bow in forward orientation.

2. A structure according to claim 1, wherein the first attachment portion and the gripping portion are adjoined to form an approximate L-shape which is characterized by an approximate right angle.

3. A structure according to claim 1, wherein the underside of the gripping portion is equipped with a plurality of finger-receiving grooves.

4. A structure according to claim 1, wherein the first attachment portion is equipped with a plurality of apertures extending laterally along the first attachment portion for receiving other instruments.

5. A structure according to claim 1, wherein the first attachment portion is secured in forward orientation by the connecting means to a central region of the riser on the archery bow, such that when normally carried, the archery bow, on either side of the riser, is curved downwardly away from the riser, so as to have a lower the center of gravity and help to maintain the balance side to side and end to end of the archery bow when carried.

6. A rigid structure in combination with an archery bow, said rigid structure comprising:

a gripping portion;

a first attachment portion adjoined to the gripping portion, the gripping portion and first attachment portion forming an L-shape;

the first attachment portion being secured to a riser on the archery bow in forward orientation, wherein the first attachment portion is secured to a central region of the riser on the archery bow, in forward orientation, such that when normally carried, the archery bow, on either side of the riser, is curved downwardly away from the riser, so as to have a lower the center of gravity and help to maintain the balance side to side and end to end of the archery bow when carried.

7. A structure according to claim 6, and further comprising a second attachment portion spaced from the first attachment portion to give the structure a "U" shape, the second attachment portion being secured in forward orientation to the central region of the riser of the archery bow.

8. A structure according to claim 7, wherein the structure is incorporated as a part of the riser to thereby significantly contribute to the structural integrity of the riser.

9. A structure according to claim 6, wherein a mounting means is provided for supporting the archery bow above ground level, the mounting means comprising an elongated ground supporting base at its lower end and a means for releasably and securably receiving the handle portion of the structure at its upper end.

10. A structure according to claim 6, wherein a mounting means is provided for supporting the archery bow on a horizontal flat surface, the mounting means comprising an elongated brace at one end of which is a means for releasably and securably receiving the handle portion of the structure and at the other end of which is a flat base for supportably resting on the flat surface.

11. A structure according to claim 6, wherein a mounting means is provided for supporting the archery bow on a horizontal flat surface, wherein the mounting means is a rod angled when in position to extend rearwardly to a position behind the bow and end at a support surface which can rest on an erected horizontal surface in such a manner that the bow can find equilibrium in a vertical orientation.

12. A structure according to claim 6, wherein the first attachment portion comprises one or more slots extending at a free end thereof and one or more fastening means to extend through the slots and releasably engage the structure to the riser of the archery bow.

13. A structure according to claim 12, wherein the one or more slots extending through the first attachment portion are elongated to permit adjustable attachment of the structure to the riser of the bow.

14. A structure according to claim 6, wherein the first attachment portion and the gripping portion are adjoined to form an approximate L-shape which is characterized by an approximate right angle.

15. A structure according to claim 6, wherein the underside of the gripping portion is equipped with a plurality of finger-receiving grooves.

16. A structure according to claim 6, wherein the first attachment portion is equipped with a plurality of apertures extending laterally along the first attachment portion for receiving other instruments.

* * * * *